US010179463B2

(12) United States Patent
Moto et al.

(10) Patent No.: US 10,179,463 B2
(45) Date of Patent: Jan. 15, 2019

(54) THERMAL HEAD AND THERMAL PRINTER

(71) Applicant: KYOCERA Corporation, Kyoto-shi, Kyoto (JP)

(72) Inventors: Youichi Moto, Kirishima (JP); Takashi Asou, Kirishima (JP); Ryohei Matsubara, Okaya (JP); Yui Tanaka, Muko (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/561,798

(22) PCT Filed: Mar. 24, 2016

(86) PCT No.: PCT/JP2016/059442
§ 371 (c)(1),
(2) Date: Sep. 26, 2017

(87) PCT Pub. No.: WO2016/158685
PCT Pub. Date: Oct. 6, 2016

(65) Prior Publication Data

US 2018/0056667 A1 Mar. 1, 2018

(30) Foreign Application Priority Data

Mar. 27, 2015 (JP) ..... 2015-066693

(51) Int. Cl.
*B41J 2/335* (2006.01)

(52) U.S. Cl.
CPC ..... *B41J 2/33595* (2013.01); *B41J 2/3351* (2013.01); *B41J 2/3352* (2013.01);
(Continued)

(58) Field of Classification Search
CPC . B41J 2/335; B41J 2/34; B41J 2/33595; B41J 2/3357; B41J 2/3354; B41J 2/33525;
(Continued)

(56) References Cited

U.S. PATENT DOCUMENTS 6,664,874 B2 * 12/2003 Shirasaki ..... H01L 23/66 333/245
2006/0098052 A1 * 5/2006 Inokuma ..... B41J 2/3351 347/64

(Continued)

FOREIGN PATENT DOCUMENTS

JP 04-052056 A 2/1992
JP 10-119335 A 5/1998

(Continued)

OTHER PUBLICATIONS

Computer-generated translation of JP 10-119335, published on May 1998.*

(Continued)

*Primary Examiner* — Huan Tran
(74) *Attorney, Agent, or Firm* — Volpe and Koenig, P.C.

(57) ABSTRACT

A thermal head includes a substrate; a heat generating section disposed on the substrate; an electrode electrically connected to the heat generating section; a cover layer which covers part of the electrode; a pad electrically connected to the electrode; and a joining member electrically connected to the pad. The cover layer includes a first portion and a second portion which is smaller in thickness than the first portion. The second portion is placed on the pad. The pad has a convexity which exposes from the second portion. The joining member is connected to the convexity.

16 Claims, 12 Drawing Sheets

(52) U.S. Cl.
CPC ..... *B41J 2/3353* (2013.01); *B41J 2/3354* (2013.01); *B41J 2/3357* (2013.01); *B41J 2/3359* (2013.01); *B41J 2/33515* (2013.01); *B41J 2/33525* (2013.01); *B41J 2/33535* (2013.01)

(58) Field of Classification Search
CPC .... B41J 2/33535; B41J 2/3359; B41J 2/3352; B41J 2/33515; B41J 2/3351; B41J 2/3353
See application file for complete search history.

(56) References Cited

U.S. PATENT DOCUMENTS

| | | | | |
|---|---|---|---|---|
| 2014/0022325 | A1* | 1/2014 | Miyamura | B41J 2/345 347/200 |
| 2018/0056667 | A1* | 3/2018 | Moto | B41J 2/3351 |

FOREIGN PATENT DOCUMENTS

| | | | |
|---|---|---|---|
| JP | 2006-035722 | A | 2/2006 |
| JP | 2009-202349 | A | 9/2009 |

OTHER PUBLICATIONS

International Search Report, PCT/JP2016/059442, dated May 31, 2016, 1 pg.

* cited by examiner

THERMAL HEAD AND THERMAL PRINTER

TECHNICAL FIELD

The present invention relates to a thermal head and a thermal printer.

BACKGROUND ART

As printing devices for use in facsimiles, video printers, and so forth, various types of thermal heads have been conventionally proposed. For example, there is known a thermal head comprising a substrate; a heat generating section disposed on the substrate; an electrode disposed on the substrate so as to be electrically connected to the heat generating section; a cover layer disposed on the substrate so as to cover part of the electrode; a pad disposed on the substrate so as to be electrically connected to the electrode; and a joining member electrically connected to the pad (refer to Patent Literature 1).

CITATION LIST

Patent Literature

Patent Literature 1: Japanese Unexamined Patent Publication JP-A 4-052056 (1992.

SUMMARY OF INVENTION

A thermal head according to the disclosure comprises: a substrate; a heat generating section disposed on the substrate; an electrode disposed on the substrate so as to be electrically connected to the heat generating section; a cover layer disposed on the substrate so as to cover part of the electrode; a pad disposed on the substrate so as to be electrically connected to the electrode; and a joining member electrically connected to the pad. Moreover, the cover layer comprises a first portion and a second portion which is smaller in thickness than the first portion. Moreover, the second portion is placed on the pad. Moreover, the pad has an exposed portion which exposes from the second portion. Moreover, the joining member is connected to the exposed portion.

A thermal printer according to the disclosure comprises: the thermal head mentioned above; a conveyance mechanism which conveys a recording medium onto the heat generating section; and a platen roller which presses the recording medium against the heat generating section.

DESCRIPTION OF EMBODIMENTS

<First Embodiment>

Figure 1:
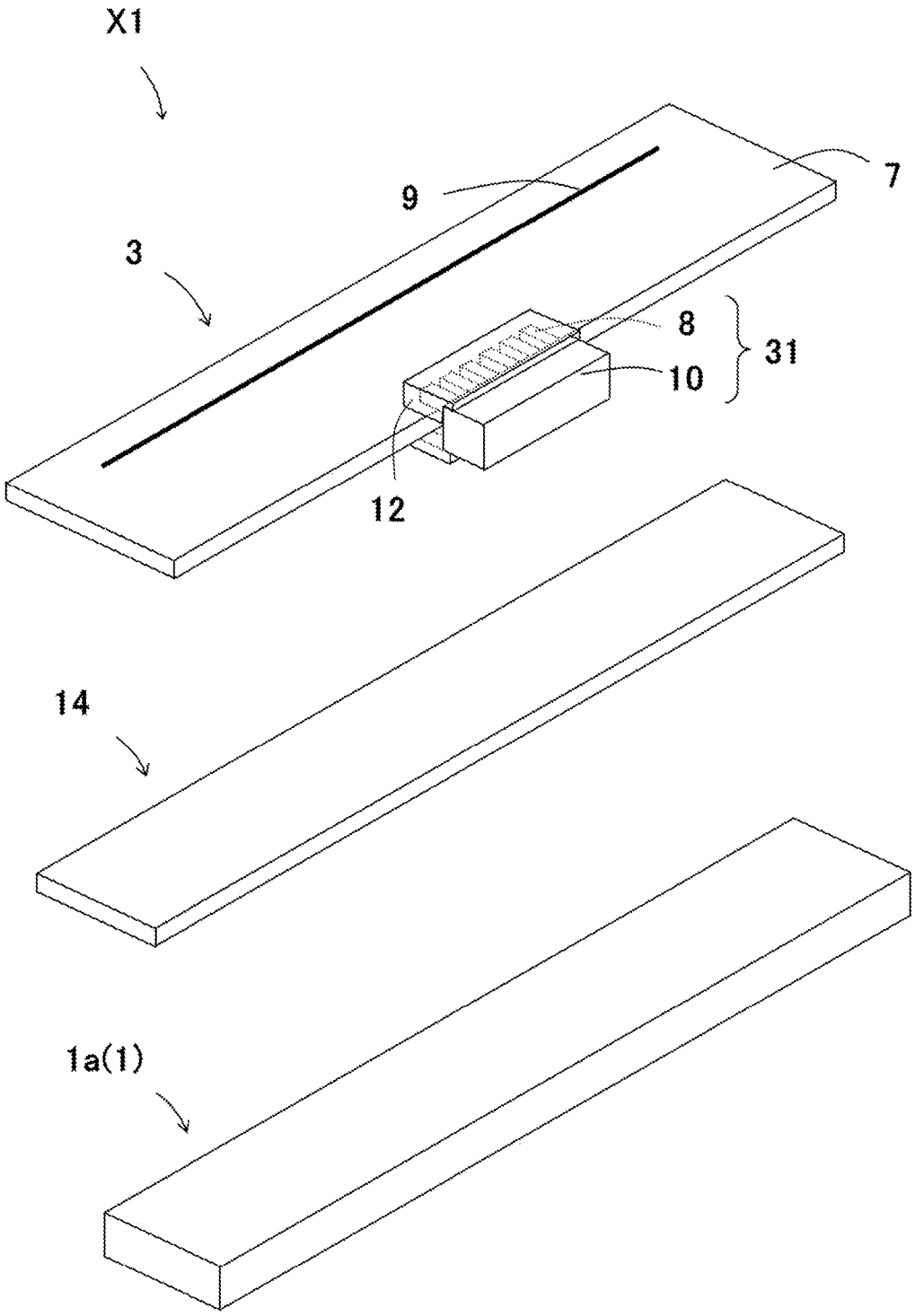
FIG. 1 is an exploded perspective view schematically showing a thermal head according to a first embodiment.
Figure 2:
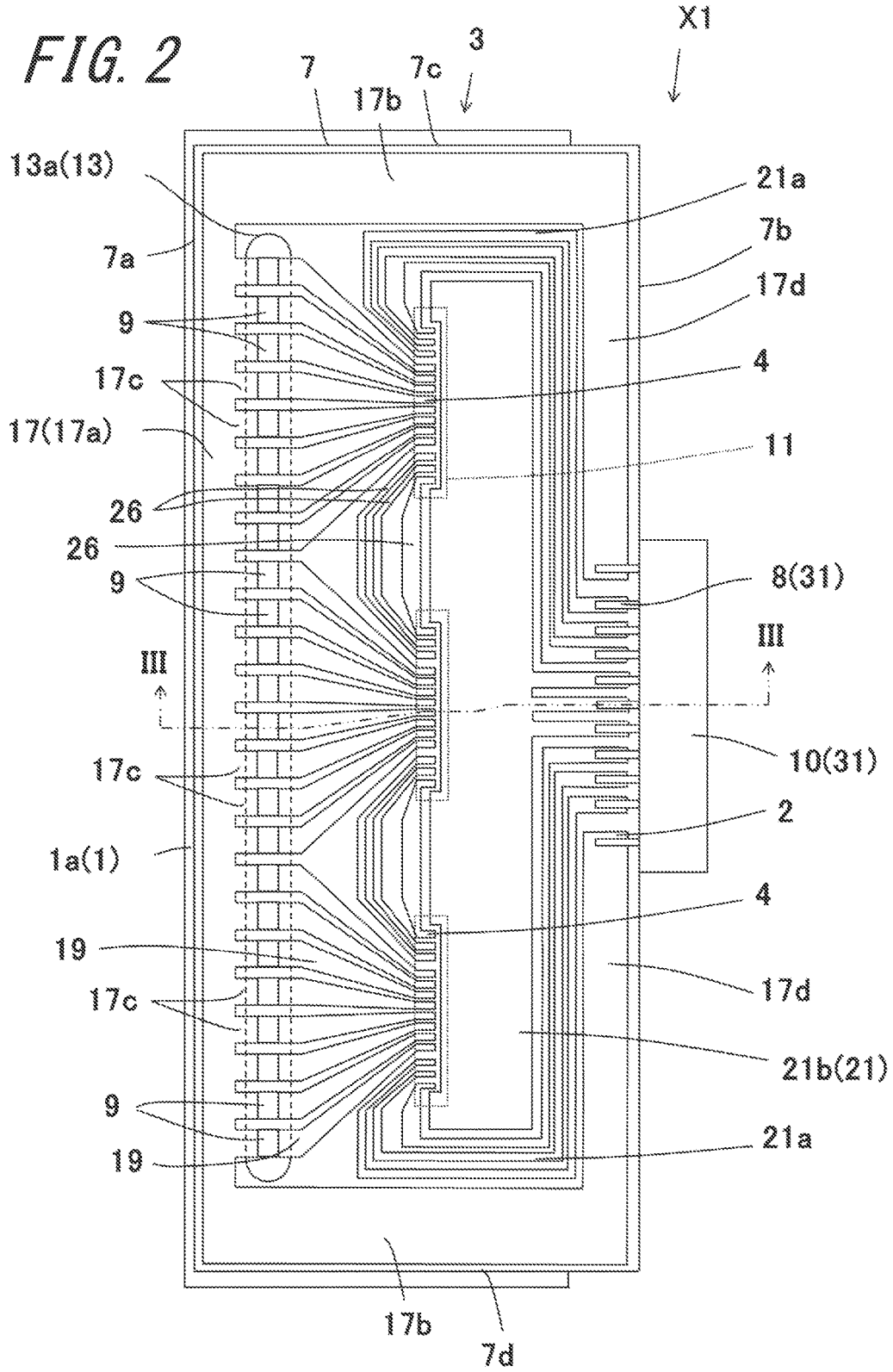
FIG. 2 is a plan view showing the thermal head shown in FIG. 1.

Hereinafter, a thermal head X1 will be described with reference to FIGS. 1 to 5B. FIG. 1 schematically shows the structure or the thermal head X1. In FIG. 2, a protective layer 25, a cover layer 27, and a sealing member 12 are omitted. Moreover, in FIGS. 4A and 4B, the region formed with the sealing member 12 is represented by a dotted area.

The thermal head X1 comprises: a head base body 3; a connector 31; the sealing member 12; a heat dissipating plate 1; and a bonding member 14. The thermal head X1 is constructed by placing the head base body 3 on the heat dissipating plate 1 via the bonding member 14. In the head base body 3, a heat generating section 9 is operated to generate heat under external voltage application to perform printing on a non-illustrated recording medium. The connector 31 provides electrical connection between the head base body 3 and the exterior thereof. The sealing member 12 allows joining together of the connector 31 and the head base body 3. The heat dissipating plate 1 is provided to dissipate heat generated in the head base body 3. The bonding member 14 bonds the head base body 3 and the heat dissipating plate 1 together.

The heat dissipating plate 1 has a rectangular parallelepiped shape and has a base portion 1*a* on which a substrate 7 is placed. The heat dissipating plate 1 is formed of a metal material such for example as copper, iron, or aluminum, and functions to dissipate part of the heat generated in the heat generating section 9 of the head base body 3 which part is not conducive to printing.

The head base body 3 is formed in a rectangular shape as seen in a plan view, and, each constituent member of the thermal head X1 is disposed on the substrate 7 of the head base body 3. The head base body 3 functions to perform printing on a non-illustrated recording medium in accordance with an electric signal supplied externally.

The connector 31 is electrically connected to the head base body 3 for electrical connection between the head base body and an external power supply. The connector 31 comprises a plurality of connector pins 8 and a housing 10 for accommodating the plurality of connector pins 8. The plurality of connector pins 8 are disposed on upper and lower sides of the substrate 7 so as to securely hold the substrate 7, and, the connector pin 8 located on the upper side is electrically connected to a pad 2 of the head base body 3 (refer to FIG. 2).

The sealing member 12 is provided so as to avoid that the pad 2 and the connector pin 8 are exposed to the outside, and can be formed of a thermosetting epoxy resin, an ultraviolet-curable resin, or a visible light-curable resin, for example. Moreover, the placement of the sealing member 12 helps increase the strength of adhesion between the connector 31 and the head base body 3.

The bonding member 14 is placed on an upper surface of the base portion 1*a* of the heat dissipating plate 1 for the bonding together of the head base body 3 and the heat dissipating plate 1. Examples of the bonding member 14 include a double-faced tape and a resin adhesive.

Hereinafter, individual members constituting the head base body 3 will be described with reference to FIGS. 2 to 5B.

The substrate 7 is placed on the base portion 1*a* of the heat dissipating plate 1, and has a rectangular shape as seen in a plan view. Thus, the substrate 7 is defined by one long side 7*a*, the other long side 7*b*, one short side 7*c*, and the other short side 7*d*. For example, the substrate 7 is formed of an electrically insulating material such as alumina ceramics, or a semiconductor material such as single-crystal silicon.

On the substrate 7 is disposed a heat storage layer 13. The heat storage layer 13 comprises a protuberant portion 13*a* formed so as to protrude from the substrate 7 upward. The protuberant portion 13*a* is located next to the one long side 7*a* of the substrate 7, extends in strip form along a direction in which the plurality of heat generating sections 9 are disposed, and has a substantially semi-elliptical sectional profile. Moreover, the protuberant portion 13*a* serves to satisfactorily press a recording medium P which is subjected to printing (refer to FIG. 5B) against a protective layer 25 formed on the heat generating section 9. The protuberant portion 13*a* is preferably designed so that its height from the substrate 7 falls in the range of 15 to 90 μm.

The heat storage layer 13 is formed of glass having a low thermal conductivity, and temporarily stores part of the heat generated in the heat generating section 9. The heat storage layer 13 is hence capable of shortening the time required to raise the temperature of the heat generating section 9, and functioning to improve the thermal response characteristics of the thermal head X1. For example, the heat storage layer 13 is formed by applying a predetermined glass paste obtained by blending a suitable organic solvent in glass powder to an upper surface of the substrate 7 by heretofore known screen printing process or otherwise, and thereafter firing the glass paste.

An electrical resistance layer 15 is located on the upper surface of the substrate 7, as well as on an upper surface of the heat storage layer 13, and, on the electrical resistance layer 15, various electrodes constituting the head base body 3 are disposed. The electrical resistance layer 15 is patterned in the same configuration as that of each electrode constituting the head base body 3, and has exposed regions each serving as an exposed electrical resistance layer 15 region lying between the common electrode 17 and the discrete electrode 19. The exposed regions constitute the heat generating sections 9, and are arranged in an array on the protuberant portion 13*a*.

The plurality of heat generating sections 9, while being illustrated in simplified form in FIG. 2 for convenience in explanation, are arranged at a density of 100 to 2400 dpi (dot per inch), for example. The electrical resistance layer 15 is formed of a material having a relatively high electrical resistance such for example as a TaN-based material, a TaSiO-based material, a TaSiNO-based material, a TiSiO-based material, a TiSiCO-based material, or a NbSiO-based material. Hence, upon application of a voltage to the heat generating section 9, the heat generating section 9 generates heat under Joule heating effect.

The common electrode 17 comprises: main wiring portions 17*a* and 17*d*; sub wiring portions 17*b*; and lead portions 17*c*. The common electrode 17 provides electrical connection between the connector 31 and the plurality of heat generating sections 9. The main wiring portion 17*a* extends along the one long side 7*a* of the substrate 7. The sub wiring portions 17*b* extend along the one short side 7*c* and the other short side 7*d*, respectively, of the substrate 7. The lead portions 17*c* extend from the main wiring portion 17*a* toward the corresponding heat generating sections 9 on an individual basis. The main wiring portion 17*d* extends along the other long side 7*b* of the substrate 7.

The plurality of discrete electrodes 19 provide electrical connection between the heat generating section 9 and a driving IC 11. Moreover, the discrete electrodes 19 allow the plurality of heat generating sections 9 to fall into a plurality of groups, and provide electrical connection between each heat generating section 9 group and corresponding one of the driving ICs 11 assigned one to each group. A pad 4 is disposed at the ends of the discrete electrodes 19. The pad 4 is electrically connected to the driving IC 11 located thereabove via a joining member 23.

There are provided a plurality of IC-connector connection electrodes 21 including a signal electrode 21*a* and a ground electrode 21*b*. The plurality of IC-connector connection electrodes 21 provide electrical connection between the driving IC 11 and the connector 31. The plurality of IC-connector connection electrodes 21 connected to the corresponding driving ICs 11 are composed of a plurality of wiring lines having different functions. Various signals are sent via the signal electrode 21*a* to the driving IC 11.

The ground electrode 21*b*, which has a large area, is placed so as to be surrounded with the discrete electrode 19, the IC-connector connection electrode 21, and the main wiring portion 17*d* of the common electrode 17. The ground electrode 4 is maintained at a ground potential of 0 to 1 V.

The pad 2 is located on a side of the other long side 7*b* of the substrate 7 to connect the common electrode 17, the discrete electrode 19, the IC-connector connection electrode 21, and the ground electrode 21*b* to the connector 31. The pad 2 is disposed corresponding to the connector pin 8, and, the connector pin 8 and the pad 2 are connected to each other so as to be electrically independent of each other at the time of connection with the connector 31.

There are provided a plurality of IC-IC connection electrodes 26 for electrical connection between adjacent driving ICs 11. The plurality of IC-IC connection electrodes 26 are each disposed corresponding to the IC-connector connection electrode 21, and transmit various signals to the adjacent driving ICs 11.

For example, the various electrodes constituting the head base body 3 mentioned above are formed by stacking layers of materials for making the corresponding electrodes on the heat storage layer 13 one after another by heretofore known thin-film forming technique such as sputtering, and thereafter working the stacked body into predetermined patterns by heretofore known photoetching process or otherwise.

Note that the various electrodes constituting the head base body 3 can be formed at one time through the same procedural steps.

As shown in FIG. 2, the driving IC 11 is disposed corresponding to each group of the plurality of heat generating sections 9, while being connected to the other end of the discrete electrode 19 and one end of the IC-connector connection electrode 21 via the joining member 23. The driving IC 11 functions to control the current-carrying condition of each heat generating section 9. As the driving IC 11, a switching member having a plurality of built-in switching elements can be used.

The driving IC 11 in a condition of being connected to the discrete electrode 19, the IC-IC connection electrode 26, and the IC-connector connection electrode 21 is sealed with a cover member 29 formed of resin such as epoxy resin or silicone resin.

Figure 3:
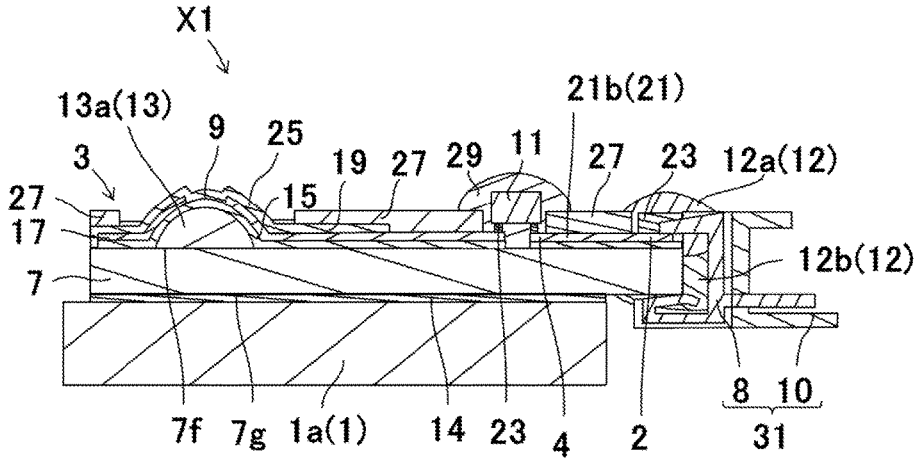
FIG. 3 is a sectional view taken along the line shown in FIG. 2.
Figure 4A:
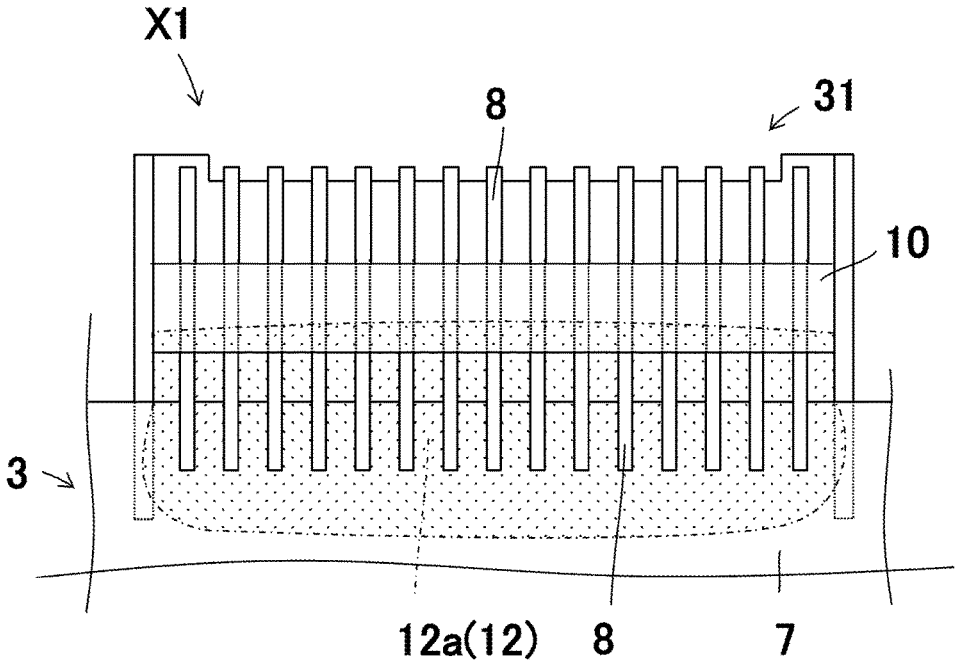
FIGS. 4A and 4B are a plan view and a bottom view, respectively, showing a connector and a vicinal region constituting the thermal head according to the first embodiment in enlarged dimension.
Figure 4B:
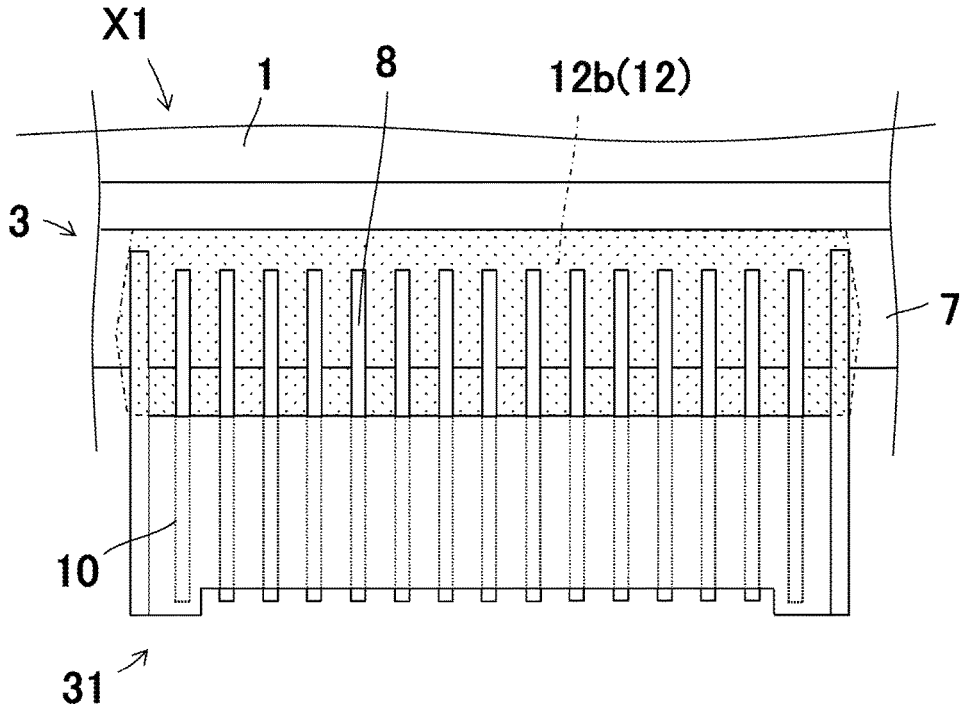

As shown in FIG. 3, on the heat storage layer 13 located on the substrate 7 is formed a protective layer 25 for covering the heat generating section 9, part of the common electrode 17, and part of the discrete electrode 19.

The protective layer 25 is intended to protect the heat generating section 9 and covered areas of the common electrode 17 and the discrete electrode 19 against corrosion caused by adhesion of atmospheric water content and so forth, or against wear caused by contact with a recording medium which is subjected to printing. The protective layer 25 may be formed from SiN, $SiO_2$, SiON, SiC, or diamond-like carbon for example, and, the protective layer 25 may be made in either a single layer form or a multilayer form. Such a protective layer 25 can be produced by thin-film forming technique such as sputtering, or thick-film forming technique such as screen printing.

Figure 5A:
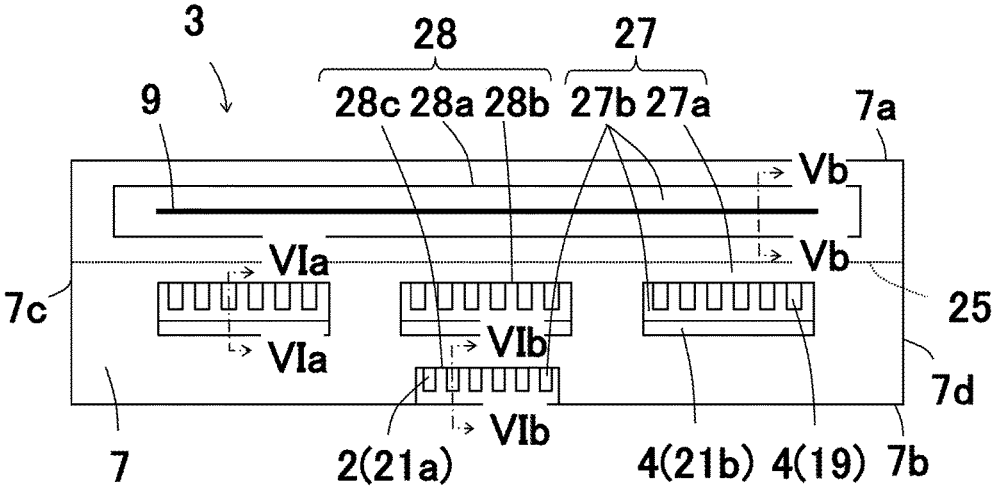
FIG. 5A is a plan view schematically showing a head base body constituting the thermal head according to the first embodiment.
Figure 5B:
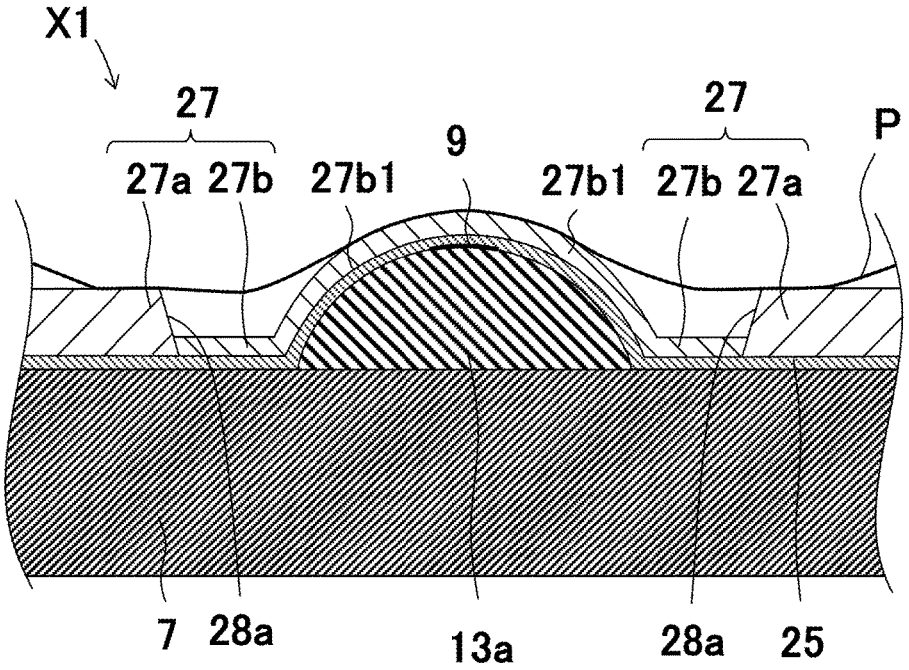
FIG. 5B is a sectional view taken along the line Va-Va shown in FIG. 5A.

Moreover, as shown in FIGS. 5A and 5B, a cover layer 27 is located on the substrate 7 to partly cover the common electrode 17, the discrete electrode 19, and the IC-connector connection electrode 21. The cover layer 27 functions to protect the covered areas of the common electrode 17, the discrete electrode 19, the IC-IC connection electrode 26, and the IC-connector connection electrode 21 against oxidation caused by exposure to air, or corrosion caused by adhesion of atmospheric water content and so forth.

The connector 31 and the head base body 3 are secured to each other via the connector pin 8, the joining member 23, and the sealing member 12. The joining member 23 is disposed between the pad 2 and the connector pin 8, or between the pad 2, 4 and the driving IC 11, and, examples of the joining member 23 include solder and an anisotropic conductive adhesive composed of electrically insulating resin mixed with conductive particles. The thermal head X1 will be described with respect to the case where a solder bump is used for the joining member 23.

Although not shown in the drawing, a Ni-, Au-, or Pd-plating layer may be interposed between the joining member 23 and the pad 2, 4. Note that the joining member 23 does not necessarily have to be disposed between the pad 2 and the connector pin 8. In this case, with use of a connector pin 8 in clip form adapted to hold the substrate 7, the pad 2 and the connector pin 8 can be electrically connected directly to each other.

The sealing member 12 comprises a first sealing member 12*a* and a second sealing member 12*b*. The first sealing member 12*a* is located on the upper surface of the substrate 7, and the second sealing member 12*b* is located on a lower surface of the substrate 7. The first sealing member 12*a* is disposed so as to seal the connector pin 8 and the various electrodes, and the second sealing member 12*b* is disposed so as to seal the connector pin 8. The first sealing member 12*a* and the second sealing member 12*b* may be made either of the same material or of different materials.

Referring to FIGS. 5A to 9B, the pad 2, 4 and the cover layer 27 will be described in detail. Note that the illustration of the driving IC 11 and the cover member 29 is omitted from FIGS. 5A and 5B. Moreover, in FIG. 5B, a recording medium P under conveyance is shown.

The cover layer 27 comprises a first portion 27*a* and a second portion 27*b* which is smaller in thickness than the first portion 27*a*. The first portion 27*a* is formed over substantially the entire area of the substrate 7, and, the first portion 27*a* has an opening 28 in which the second portion 27*b* is disposed. Part of the cover layer 27 is located on the protective layer 25, and the other rest part of the cover layer 27 is located on the substrate 7.

The opening 28 comprises a first opening 28*a*, a second opening 28*b*, and a third opening 28*c*. The first opening 28*a* is elongated in a main scanning direction so as to lie next to the one long side 7*a* of the substrate 7. The first opening 28*a* is designed to receive the plurality of heat generating sections 9 therein, and thus, inside the first opening 28*a* are disposed the heat generating section 9 and the protective layer 25. The second portion 27*b* covers the heat generating section 9 and the protective layer 25.

The second opening 28*b* is elongated in the main scanning direction and is disposed corresponding to the driving IC 11. That is, there are provided a plurality of second openings 28*b* aligned in the main scanning direction. The second opening 28*b* is designed to receive the plurality of pads 4 therein, and thus, inside the second opening 28*b* are disposed the pad 4 for the discrete electrode 19 and the pad 4 for the IC-connector connection electrode 21*b*. The second portion 27*b* covers part of the pad 4.

The third opening 28*c* is elongated in the main scanning direction and is disposed corresponding to the connector pin 8. The third opening 28*c* is designed to receive the plurality of pads 2 therein, and thus, inside the third opening 28*c* is disposed the pad 2 for the IC-connector connection electrode 21*b*. The second portion 27*b* covers part of the pad 2.

The first portion 27*a* functions to provide protection for each member located on the substrate 7. Moreover, the first portion 27*a* functions to protect each member located on the substrate 7 against contact with the recording medium P under conveyance.

It is hence preferable that the first portion 27*a* has a thickness of 10 μm to 30 μm. Given the thickness of 10 μm or more, then improvement in corrosion resistance can be achieved. Moreover, given the thickness of 30 μm or less, the recording medium P is allowed to travel substantially unimpeded.

The first portion 27*a* is required to have corrosion and wear-resistant properties, and may be formed of epoxy resin or polyimide resin, for example. As the epoxy resin, Bisphenol A or Bisphenol F can be used.

The second portion 27*b* is disposed inside the opening 28, functions to protect each member located inside the opening 28 against moisture, dust, etc., and is possessed of anti-corrosion characteristics.

As shown in FIG. 5B, the second portion 27*b* located in the first opening 28*a* is disposed on the protective layer 25 so as to extend from the first portion 27*a* toward the heat generating section 9, as well as to fill the gap between the protuberant portion 13*a* and the first portion 27*a*. Part of the second portion 27*b* constitutes an overlying portion 27*b*1 which overlies the protuberant portion 13*a*.

Figure 6A:
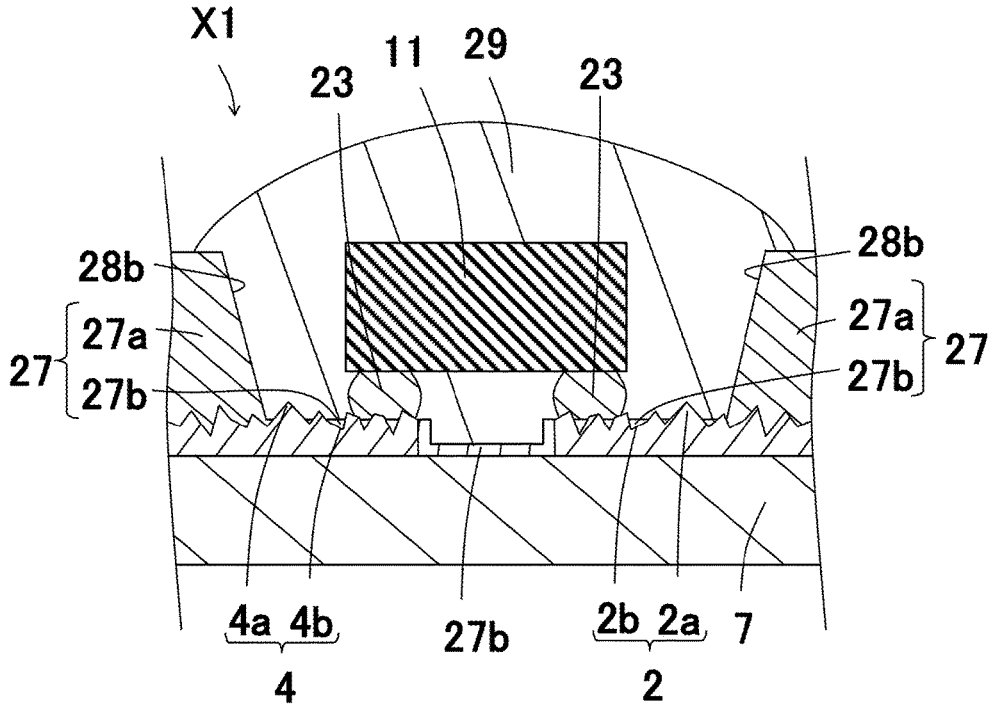
FIG. 6A is a sectional view taken along the line VIa-VIa shown in FIG. 5A.

As shown in FIG. 6A, the second portion 27*b* located in the second opening 28*b* is disposed on the pad 2, 4 and on the substrate 7 so as to extend from the first portion 27*a* toward the driving IC 11, as well as to fill the gap between the first portions 27*a* opposed to each other. The second portion 27*b* is also formed on a part of the substrate 7 which lies below the driving IC 11.

Figure 6B:
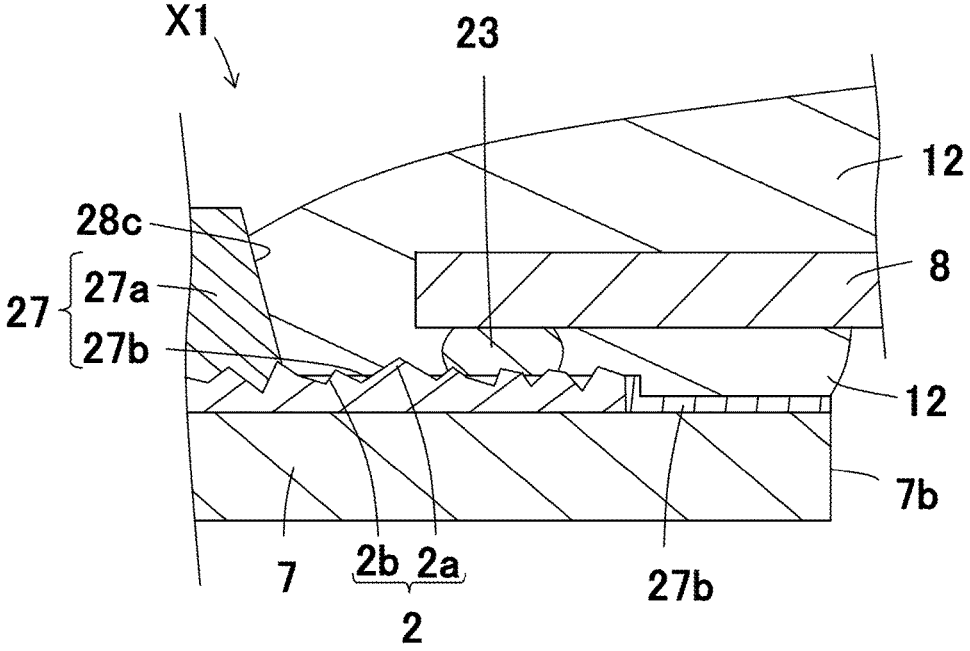
FIG. 6B is a sectional view taken along the line VIb-VIb shown in FIG. 5A.

As shown in FIG. 6B, the second portion 27*b* located in the third opening 28*c* is formed so as to extend from the first portion 27*a* toward the other long side 7*b* of the substrate 7. The second portion 27*b* is disposed on the pad 2 and on the substrate 7 so as to cover the other long side 7*b* of the substrate 7.

The second portion 27*b* may be designed to have a thickness of 0.01 μm to 1 μm. For example, the second portion 27*b* may be formed of epoxy resin or polyimide resin, for example. As the epoxy resin, Bisphenol A or the like can be used, for example.

It is preferable that the first portion 27*a* is formed of Bisphenol A and Bisphenol F, and the second portion 27*b* is formed of Bisphenol A. This makes it possible to render the first portion 27*a* and the second portion 27*b* analogous in resin material composition with each other, and thereby improve the sealing characteristics of the thermal head X1.

In the aforestated case, the first portion 27*a* can be distinguished from the second portion 27*b* by the presence of Bisphenol F, that is; the Bisphenol F-containing portion can be defined as the first portion 27*a*, and the Bisphenol F-free portion can be defined as the second portion 27*b*.

As shown in FIG. 6A, the pad 4 is made continuous with the discrete electrode 19 or the IC-connector connection electrode 21*b* so as to be electrically connected to a non-illustrated terminal of the driving IC 11 via the joining member 23. The pad 4 has a convexity 4*a* and a concavity 4*b*, and, the top of the convexity 4*a* protrudes from the second portion 27*b*. That is, the top of the convexity 4*a* is exposed to the outside of the second portion 27*b* to provide an exposed portion. In other words, the exposed portion is a part of the convexity 4*a* which is located above the level of the second portion 27*b*.

The convexity 4*a* and the concavity 4*b* are made continuous with each other, and, the pad 4 has an arithmetic surface roughness Sa of 0.1 μm to 1 μm. The arithmetic surface roughness Sa can be determined by measurement using a laser surface roughness meter or a contact type surface roughness meter. Moreover, as shown in FIG. 6A, the arithmetic surface roughness Sa of the pad 4 may be measured on the basis of an image obtained by photographing a section passing through the driving IC 11 and subjecting the photographed image to image processing operation.

A plurality of convexities 4*a* are exposed to the outside of the second portion 27*b*, the convexities 4*a* being disposed independently of each other as seen in a plan view. That is, the convexities 4*a* are apart from each other at random fashion.

There are provided a plurality of concavities 4*b* formed in a surface of the pad 4, the concavities 4*b* being disposed independently of each other when the second portion 27*b* is seen in a transparent plan view. That is, the concavities 4*b* are apart from each other at random fashion. The second portion 27*b* is received in the concavities 4*b*.

As shown in FIG. 6B, the pad 2 is made continuous with the IC-connector connection electrode 21*a* (refer to FIG. 2) or the IC-connector connection electrode 21*b* so as to be electrically connected to the connector pin 8 via the joining member 23. The pad 2 has a convexity 2*a* and a concavity 2*b*, and, the top of the convexity 2*a* protrudes from of the second portion 27*b*. That is, the top of the convexity 2*a* is exposed to the outside of the second portion 27*b* to provide an exposed portion. In other words, the exposed portion is a part of the convexity 2*a* which is located above the level of the second portion 27*b*.

The convexity 2*a* and the concavity 2*b* are made continuous with each other, and, the pad 2 has an arithmetic surface roughness Sa of 0.1 μm to 1 μm.

A plurality of convexities 2*a* are exposed to the outside of the second portion 27*b*, the convexities 2*a* being disposed independently of each other as seen in a plan view. That is, the convexities 2*a* are apart from each other at random fashion.

There are provided a plurality of concavities 2*b* formed in a surface of the pad 2, the concavities 2*b* being disposed independently of each other when the second portion 27*b* is seen in a transparent plan view. That is, the concavities 2*b* are apart from each other at random fashion. The second portion 27*b* is received in the concavities 2*b*.

A thermal head is constructed by forming various members and a cover layer on a substrate, and thereafter mounting a driving IC on a pad via a joining member. The pad makes electrical connection with the joining member, wherefore the thermal head is subjected to driving IC-mounting process, with the pad exposed. Hence, the possibility arises that due to adhesion of water or dust to the exposed pad the thermal head will be corroded.

The thermal head X1 according to this embodiment is designed so that the second portion 27*b* is placed on the pad 2, 4, the pad 2, 4 has the convexity 2*a*, 4*a* exposed to the outside of the second portion 27*a*, and, the joining member 23 is joined to the convexity 2*a*, 4*a*.

Thus, it is possible to assure electrical conduction between the pad 2, 4 and the joining member 23 by the convexity 2*a*, 4*a*, and it is possible to protect other part of the pad 2, 4 than the convexity 2*a*, 4*a* against corrosion by the second portion 27*b*. This makes it possible to improve the anti-corrosion characteristics of the thermal head X1.

Moreover, the pad 2, 4 has an arithmetic surface roughness Sa of 0.1 μm to 1 μm, and the second portion 27*b* has a thickness of 0.01 μm to 1 μm, and thus, by forming the second portion 27*b* on the pad 2, 4, the convexity 2*a*, 4*a* of the pad 2, 4 can be formed, and also the second portion 27*b* can be received in the concavity 2*b*, 4*b*. Moreover, it is preferable that the arithmetic surface roughness Sa of the pad 2, 4 falls in the range of 0.3 μm to 1 μm. the formation of the convexity 2*a*, 4*a* can be facilitated.

The arithmetic surface roughness Sa can be determined on the basis of the average level of surface asperities per reference length measured by a contact or non-contact type surface roughness meter. Moreover, the arithmetic surface roughness Sa may be determined by photographing the section of the pad 2, 4, analyzing the photographed image, and measuring the average value of surface asperities at the pad 2, 4.

Moreover, the pad 2, 4 has the plurality of convexities 2*a*, 4*a* which are apart from each other as seen in a plan view. That is, the convexities 2*a*, 4*a* are apart from each other at random fashion. Thus, The plurality of convexities 2*a*, 4*a* are disposed apart from each other. This makes it possible to connect the joining member 23 and the pad 2, 4 together at a plurality of points, and thereby increase the stability of horizontal position of the joining member 23.

The condition where the convexities 2*a*, 4*a* of the pad 2, 4 are apart from each other as seen in a plan view means that the convexities 2*a*, 4*a* are apart from each other as seen in a plan view, with the cover member 29, the driving IC, and the joining member 23 removed.

Moreover, in plan view, the total area of the convexities 2*a*, 4*a* constitutes 5 to 30% of the entire area of the pad 2, 4 inclusive of the convexities 2*a*, 4*a*. This makes it possible to assure electrical connection with the joining member 23, while improving the anti-corrosion characteristics of the pad 2, 4.

That is, where the total area of the convexities 2*a*, 4*a* is greater than or equal to 5% of the entire area of the pad 2, 4 inclusive of the convexities 2*a*, 4*a*, electrical connection with the joining member 23 can be assured. Moreover, where the total area of the convexities 2*a*, 4*a* is less than or equal to 30% of the entire area of the pad 2, 4 inclusive of the convexities 2*a*, 4*a*, corrosion of the pad 2, 4 can be suppressed. It is more preferable that the total area of the convexities 2*a*, 4*a* constitutes 10 to 20% of the area of the pad 2, 4.

The total area of the convexities 2*a* can be measured by photographing the pad 2, 4 from the plan view direction in a state where the second portion 27*b* is disposed on the pad 2, 4 and subjecting the photographed image to image processing operation. The entire area of the pad 2, 4 inclusive of the convexities 2*a*, 4*a* can be measured by mechanically or chemically removing the second portion 27*b* to uncover the pad 2, 4, photographing the pad 2, 4 from the plan view direction and subjecting the photographed image to image processing operation.

As shown in FIG. 5B, the overlying portion 27*b*1 is located above the heat generating section 9. More specifically, the second portion 27*b* is located inside the opening 28*a*, and has the overlying portion 27*b*1 which overlies the protuberant portion 13*a*. The second portion 27*b* is located on the protective layer 25 formed on the protuberant portion 13*a*, and, part of the second portion 27*b* is located above the heat generating section 9.

Hence, even when the recording medium P is conveyed while being kept in contact with the thermal head X1, the overlying portion 27*b*1 can protect the protective layer 25, with consequent improvement in the anti-wear characteristics of the thermal head X1. Moreover, since the second portion 27*b* has a thickness of 0.01 μm to 1 μm, it is possible to efficiently transmit heat generated in the heat generating section 9 to the recording medium P.

The driving IC 11 is sealed with the cover member 29 for external protection. As described earlier, the cover member 29 is formed of a resin material or the like, and, the driving IC 11 can be sealed by applying the cover member 29 so as to cover the driving IC 11 following the completion of electrical connection between the driving IC 11 and the pad 2, 4 via the sealing member 23, and thereafter curing the cover member 29.

In applying a cover member 29 in this way, when the pad 2, 4 has an arithmetic surface roughness Sa of 0.1 μm to 1 μm, a gap may be left between the cover member 29 and the pad 2, 4, which results in a decrease in the strength of adhesion between the cover member 29 and the pad 2, 4. Furthermore, when air present in the gap remains as air bubbles within the cover member 29, the possibility arises that due to the actuation of the thermal head X1 under heat air bubble expansion will occur, causing damage to the thermal head X1.

In the thermal head X1 according to this embodiment, the pad 4, 6 has an arithmetic surface roughness Sa of 0.1 μm to 1 μm, and, the second portion 27*b* is received in the concavity 2*b*, 4*b*, wherefore the surface of the pad 4, 6 can be smoothed by the second portion 27*b*. This makes it possible to arrange the cover member 29 tightly on a smooth upper surface of the pad 4, 6, and thereby reduce the possibility of leaving a gap between the cover member 29 and the pad 2, 4. Hence, the strength of adhesion between the cover member 29 and the pad 2, 4 can be increased.

Moreover, by virtue of the tight arrangement of the cover member 29 on the smooth upper surface of the pad 4, 6, a gap is less likely to appear between the cover member 29 and the pad 2, 4, wherefore air bubbles remaining within the cover member 29 can be reduced. damage to the thermal head X1 can be reduced.

Moreover, it is preferable that the second portion 27*b* has a thickness of 0.01 μm to 1 μm. This allows the second portion 27*b* to be received in the concavity 2*b*, 4*b* of the pad 2, 4, with a consequent increase in the degree of smoothness of the pad 2, 4.

Moreover, the second portion 27*b* is located between the driving IC 11 and the pad 2, 4. That is, as shown in FIG. 6A, the second portion 27*b* is formed on the pad 2, 4 located below the driving IC 11. In this case, the joining member 23 is restrained from finding its way into the concavity 2*b*, 4*b*, wherefore collapsing of the joining member 23 is less prone to occur. This makes it possible to maintain the joining member 23 in stable form, and thereby mount the driving IC 11 with stability.

A method for manufacturing the thermal head X1 will be described with reference to FIGS. 7A to 9B.

Figure 7A:
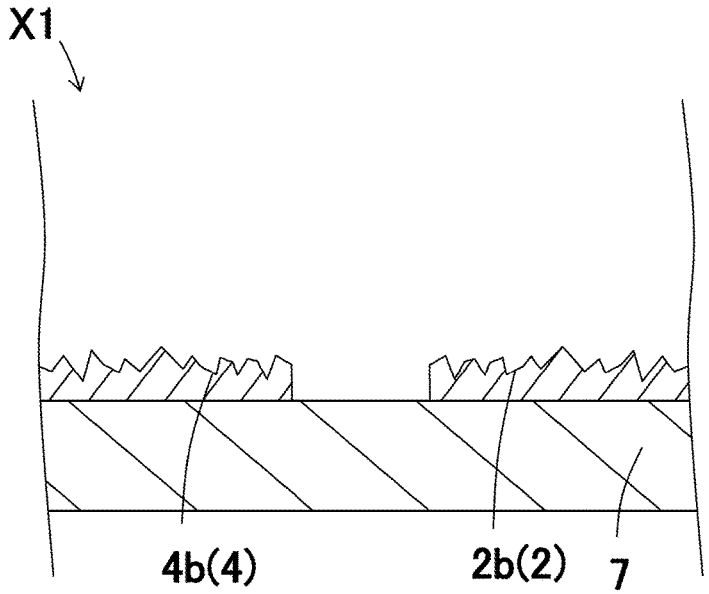
FIG. 7A is a sectional view showing a manufacturing step of the thermal head according to the first embodiment.
Figure 7B:
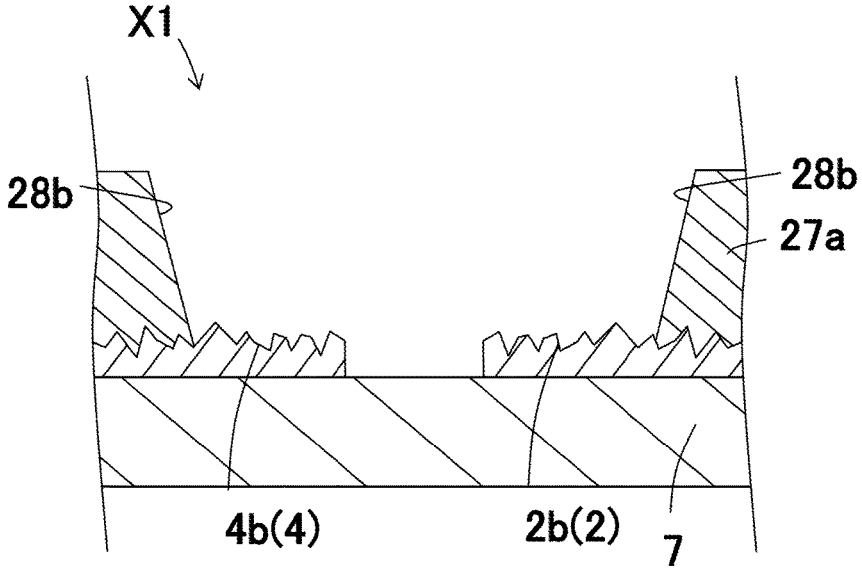
FIG. 7B is a sectional view showing a manufacturing step of the thermal head according to the first embodiment.

First, the electrical resistance layer 15 (refer to FIG. 3) and layers of materials for making the various electrode layers and the pads 2 and 4, respectively, are formed one after another on the substrate 7 by sputtering technique. Next, as shown in FIG. 7A, following the patterning of the electrical resistance layer 15 and the material layers by photolithography technique, the heat generating section 9 (refer to FIG. 3), various electrodes, and the pads 2 and 4 are formed by dry etching process. At this time, the pad 2, 4 is formed so as to have an arithmetic surface roughness Sa of 0.1 μm to 1 μm, and also the convexity 2*a*, 4*a* of the pad 2, 4 is simultaneously formed. Note that etching process may be conducted to form the convexity 2*a*, 4*a* with use of an etching solution of, for example, mixed acid. Subsequently, the protective layer 25 is formed by sputtering technique so as to cover the heat generating section 9.

Next, in order to form the first portion 27*a*, Bisphenol A, Bisphenol F, and imidazole are mixed to prepare a first portion 27*a*-forming resin. Moreover, to form the second portion 27*b*, Bisphenol A and imidazole are mixed to prepare a second portion 27*b*-forming resin.

Figure 8A:
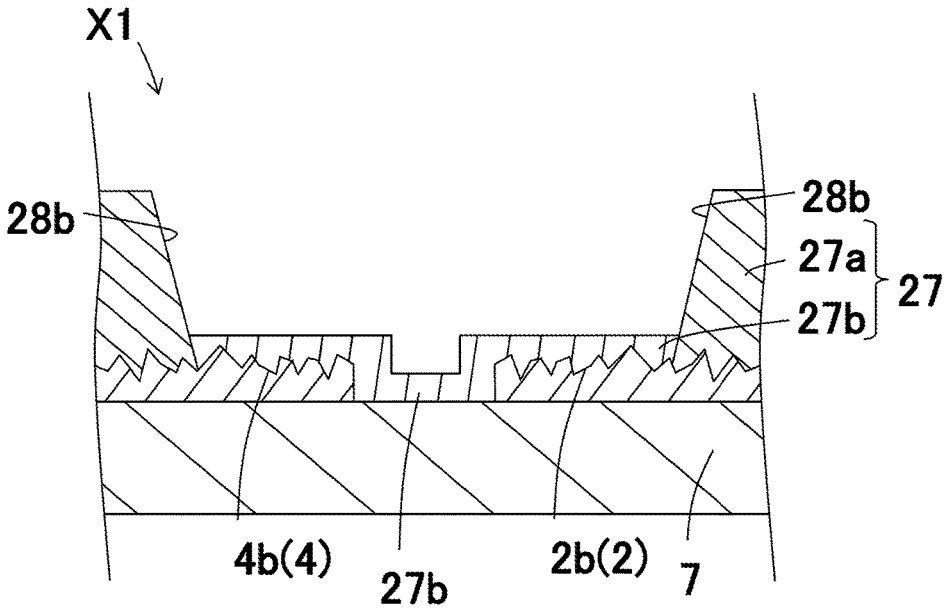
FIG. 8A is a sectional view showing a manufacturing step of the thermal head according to the first embodiment.

Subsequently, the first portion 27*a*-forming resin is applied to the substrate 7 by printing technique. At this time, the application of the first portion 27*a*-forming resin is performed so that the opening 28*b* is created to uncover the pad 2, 4. Next, as shown in FIG. 8A, the second portion 27*b*-forming resin is applied to an exposed region lying inside the opening 28*b*. The second portion 27*b*-forming resin is applied onto part of the pad 2, 4 which is exposed to the opening 28*b* by means of screen printing, a dispenser, or otherwise. In this way, the second portion 27*b* can be received in the concavity 2*b*, 4*b*. Moreover, the second portion 27*b* can be formed on a part of the substrate 7 which lies between the pad 2 and the pad 4 disposed adjacent to each other.

The cover layer 27 may be formed also by applying a mixture of the first portion 27*a*-forming resin and the second portion 27*b*-forming resin by printing technique so that the opening 28*b* is created. In this case, the first portion 27*a* and the second portion 27*b* can be formed by applying the mixture of the first portion 27*a*-forming resin and the second portion 27*b*-forming resin, allowing the resin mixture to stand for a predetermined period of time, and performing a drying process.

Figure 8B:
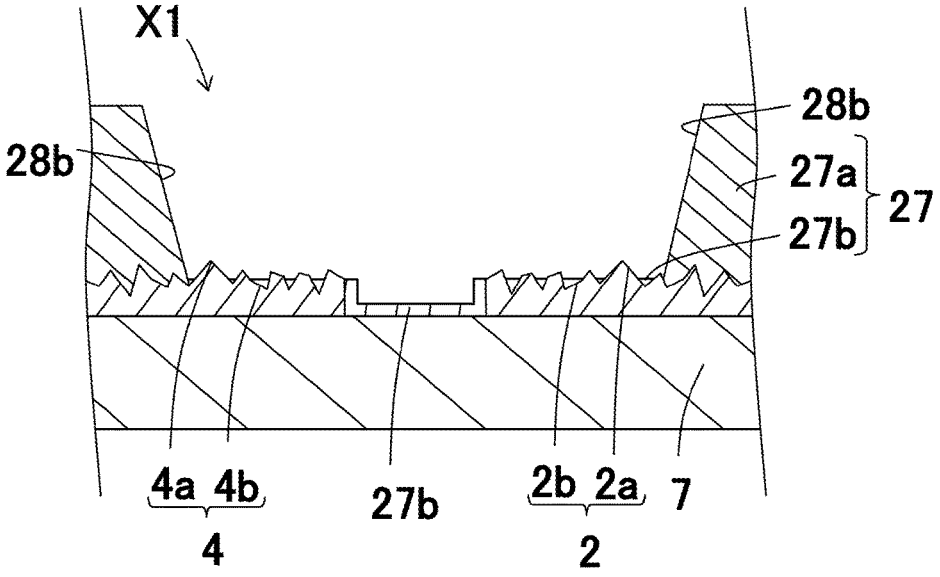
FIG. 8B is a sectional view showing a manufacturing step of the thermal head according to the first embodiment.

Subsequently, as shown in FIG. 8B, part of the second portion 27*b* is removed to form the convexity 2*a*, 4*a* of the pad 2, 4. For example, the second portion 27*b* may be removed by wiping the region inside the opening 28*b* with an isopropyl alcohol-coated non-woven cloth. In this way, the pad 2, 4 is formed with the convexity 2*a*, 4*a*, and, the top of the convexity 2*a*, 4*a* is exposed to the outside of the second portion 27*b*, and also the second portion 27*b* remains in the concavity 2*b*, 4*b*.

It is also possible to, following the formation of the second portion 27*b*, remove part of the second portion 27*b* by washing the entire thermal head X1 by plasma cleaning process using a plasma cleaner.

Figure 9A:
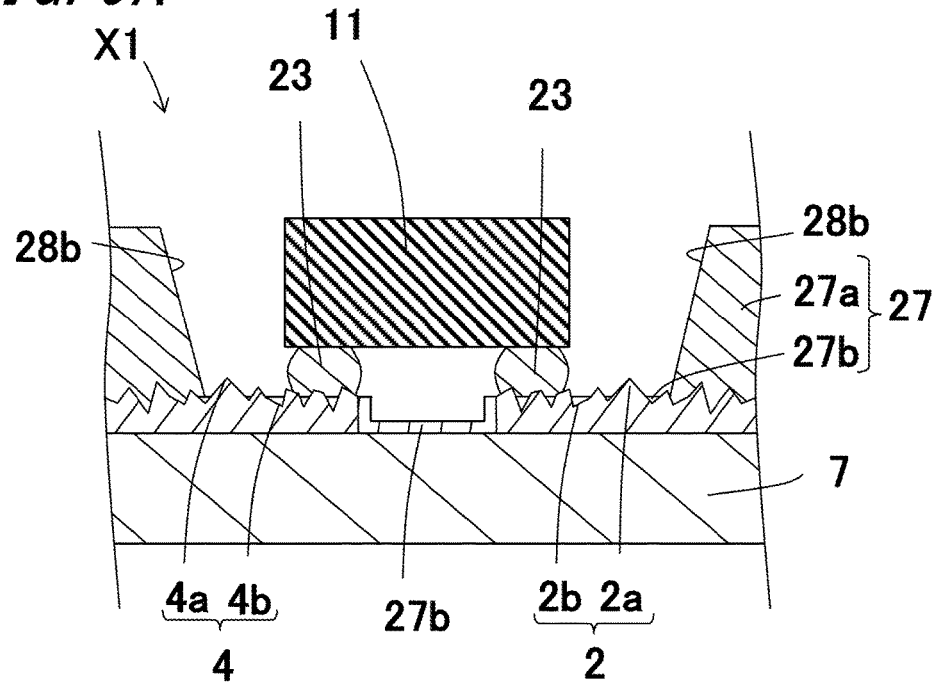
FIG. 9A is a sectional view showing a manufacturing step of the thermal head according to the first embodiment.
Figure 9B:
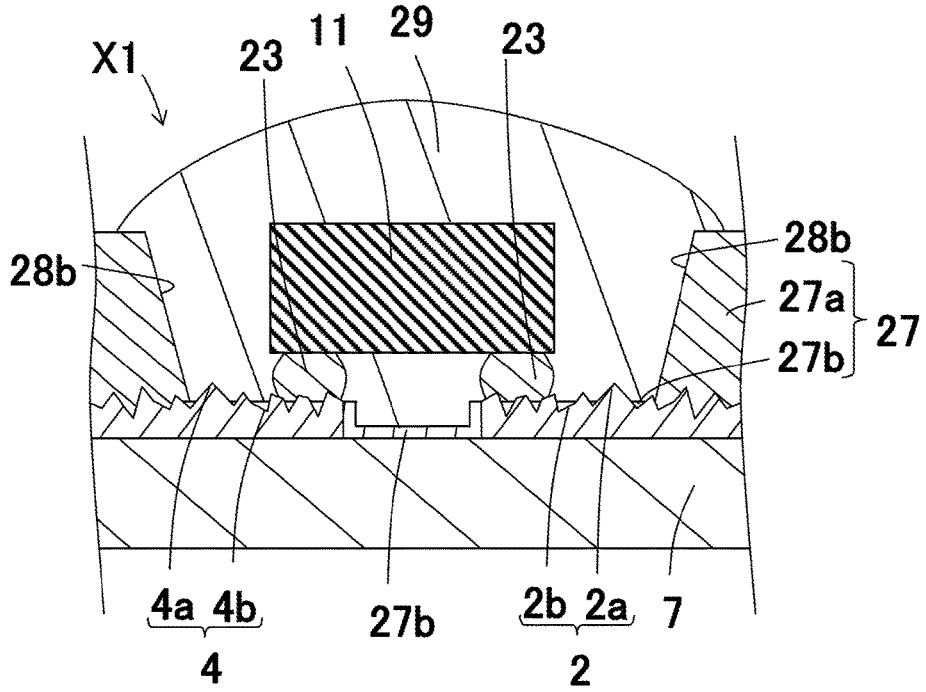
FIG. 9B is a sectional view showing a manufacturing step of the thermal head according to the first embodiment.

Then, as shown in FIG. 9A, the driving IC 11 provided with the joining member 23 is mounted on the pad 2, 4 so as to electrically connect the convexity 2*a*, 4*a* of the pad 2, 4 and the joining member 23.

Subsequently, the cover member 29 is applied to the opening 28*b* by a dispenser so as to embed the driving IC 11, and is then cured to seal the driving IC 11. The edge of the cover member 29 is located on the first portion 27*a* of the cover layer 27, and can be restrained from spreading out. It is also possible to provide the cover member 29 for each driving IC 11 on an individual basis, as well as to dispose the cover member 29 so as to extend in the main scanning direction for simultaneous covering of the plurality of driving ICs 11.

Thus, the placement of the second portion 27*b* for receipt in the concavity 2*b*, 4*b* of the pad 2, 4 imparts smoothed surface to the pad 2, 4. In consequence, the cover member 29 is allowed to spread smoothly over the surface of the pad 2, 4, thus effecting a reduction in the possibility of leaving a gap between the surface of the pad 2, 4 and the cover member 29.

Moreover, by virtue of the placement of the second portion 27*b* on a part of the substrate 7 which lies between the pad 2 and the pad 4, even if the substrate 7 has surface irregularities, the second portion 27*b* serves to smooth the irregularities of the substrate 7, wherefore the cover member 29 is allowed to spread smoothly over the surfaces of the pad and the second portion 27*b*. The possibility of occurrence of air bubbles under the driving IC 11 can be reduced.

Next, a thermal printer Z1 will be described with reference to FIG. 10.

Figure 10:
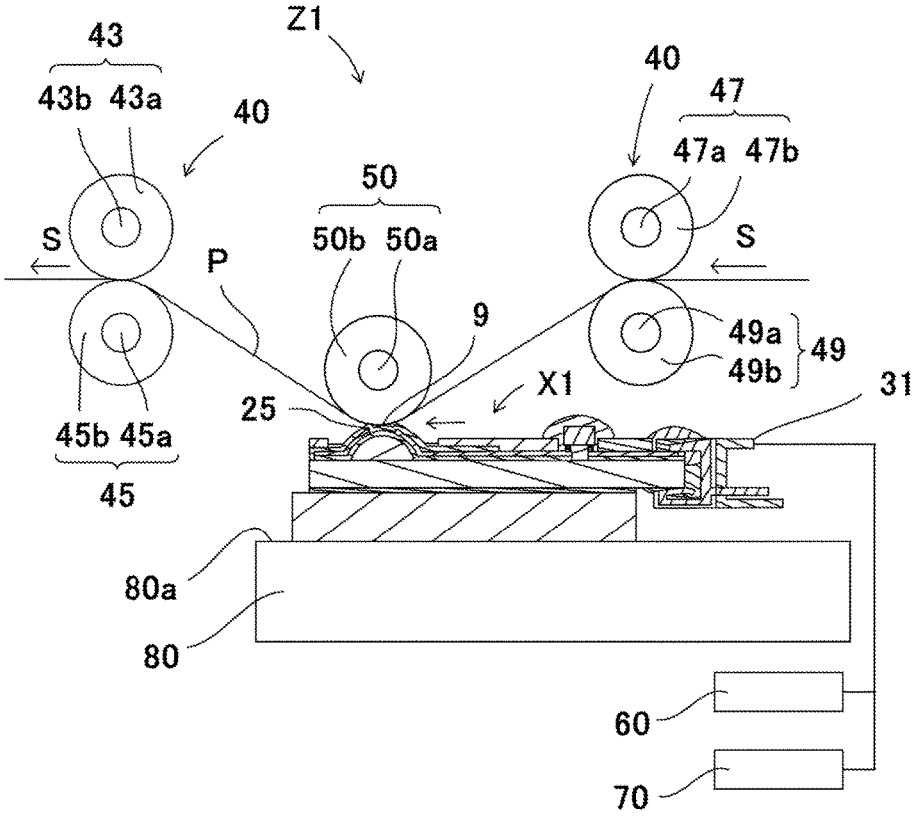
FIG. 10 is a schematic view showing a thermal printer according to the first embodiment.

As shown in FIG. 10, the thermal printer Z1 according to the present embodiment comprises: the aforestated thermal head X1; a conveyance mechanism 40; a platen roller 50; a power-supply device 60; and a control unit 70. The thermal head X1 is attached to a mounting face 80*a* of a mounting member 80 disposed in a non-illustrated casing for the thermal printer Z1. The thermal head X1 is mounted on the mounting member 80 so as to be oriented along the main scanning direction which is perpendicular to a conveying direction S of the recording medium P which will hereafter be described.

The conveyance mechanism 40 comprises a non-illustrated driving section and conveying rollers 43, 45, 47, and 49. The conveyance mechanism 40 is intended to convey the recording medium P, such as thermal paper or ink-transferable image receiving paper, in a direction indicated by arrow S shown in FIG. 10 to the protective layer 25 located on the plurality of heat generating sections 9 of the thermal head X1. The driving section functions to drive the conveying rollers 43, 45, 47, and 49, and, for example, a motor may be used for the driving section. For example, the conveying roller 43, 45, 47, 49 is composed of a cylindrical shaft body 43*a*, 45*a*, 47*a*, 49*a* formed of metal such as stainless steel covered with an elastic member 43*b*, 45*b*, 47*b*, 49*b* formed of butadiene rubber or the like. Although not shown in the drawing, when using ink-transferable image receiving paper or the like as the recording medium P, the recording medium P is conveyed together with an ink film which lies between the recording medium P and the heat generating section 9 of the thermal head X1.

The platen roller 50 functions to press the recording medium P against the protective layer 25 located on the heat generating section 9 of the thermal head X1. The platen roller 50 is disposed so as to extend along a direction perpendicular to the conveying direction S of the recording medium P, and is fixedly supported at ends thereof so as to be rotatable while pressing the recording medium P against the heat generating section 9. For example, the platen roller 50 may be composed of a cylindrical shaft body 50*a* formed of metal such as stainless steel covered with an elastic member 50*b* formed of butadiene rubber or the like.

The power-supply device 60 functions to supply electric current for enabling the heat generating section 9 of the thermal head X1 to generate heat as described above, as well as electric current for operating the driving IC 11. The control unit 70 functions to feed a control signal for controlling the operation of the driving IC 11 to the driving IC 11 in order to cause the heat generating sections 9 of the thermal head X1 to selectively generate heat as described above.

The thermal printer Z1 performs predetermined printing on the recording medium P by conveying the recording medium P onto the heat generating section 9 of the thermal head X1 by the conveyance mechanism 40 while pressing the recording medium P against the heat generating section 9 by the platen roller 50, and operating the power-supply device 60 and the control unit 70 to cause the heat generating sections 9 to selectively generate heat. When using image receiving paper or the like as the recording medium P, printing on the recording medium P is performed by thermally transferring the ink of the non-illustrated ink film which is conveyed together with the recording medium P, onto the recording medium P.

<Second Embodiment>

Figure 11:
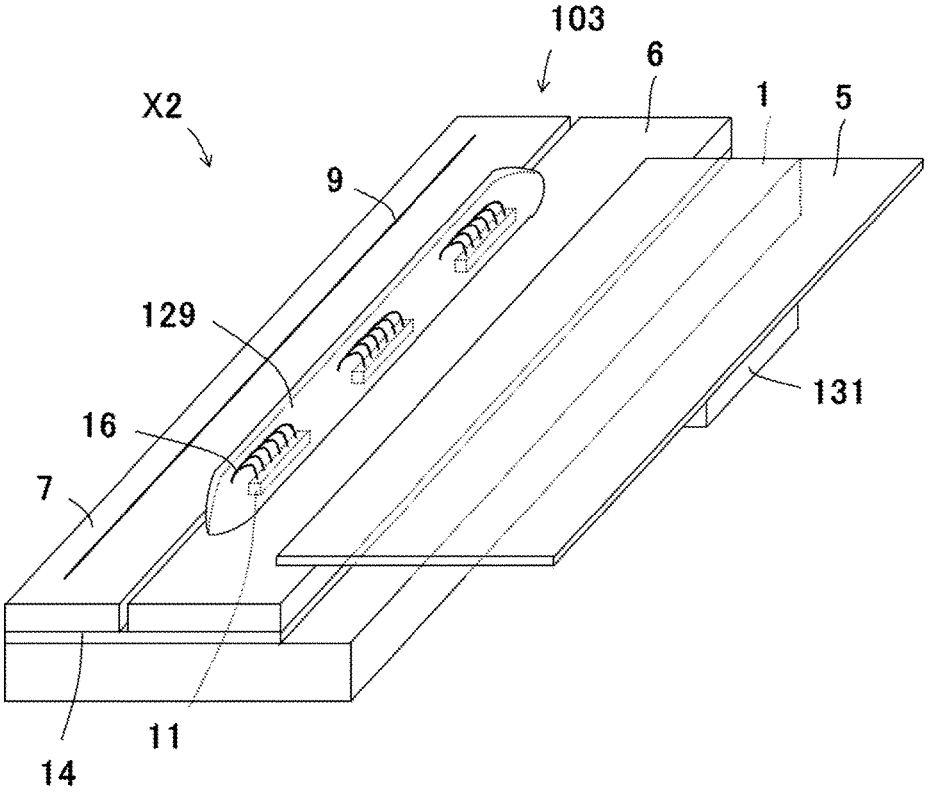
FIG. 11 is an exploded perspective view schematically showing a thermal head according to a second embodiment.

A thermal head X2 will be described with reference to FIGS. 11, 12A and 12B. Note that such members as are identical with those of the thermal head X1 will be identified with the same reference symbols throughout the following description. In the thermal head X2, a bonding wire is used for a joining member 16.

The thermal head X2 comprises: a heat dissipating plate 1; a head base body 103; a wiring substrate 6; a bonding member 14; a flexible printed circuit board 5 (hereafter referred to as "FPC 5"); and a connector 131. In the thermal head X2, the head base body 103 and the wiring substrate 6 are disposed adjacent to each other, and, on the heat dissipating plate 1, the head base body 103 and the wiring substrate 6 are placed via the bonding member 14.

The wiring substrate 6 has a flat plate elongated in the main scanning direction, and a driving IC 11 is placed on an upper surface of the wiring substrate 6. The joining member 16 formed of a bonding wire is drawn out from the driving IC 11 so as to be electrically connected to a pad 2 (refer to FIG. 2) of the head base body 103. Although not shown in the drawing, the joining member 16 is drawn out from the driving IC 11 toward the wiring substrate 6 so as to be electrically connected to a non-illustrated wiring pattern defined in the wiring substrate 6.

The wiring substrate 6 is internally provided with a wiring pattern, and, the FPC 5 and the head base body 103 are electrically connected to each other via the wiring pattern. Examples of the wiring substrate 6 include a hard rigid substrate and a PCB.

The FPC 5 is electrically connected to the wiring substrate 6, and is electrically connected to the exterior thereof via the connector 131. The FPC 5 is formed of a flexible printed circuit board.

A cover member 129 is formed so as to extend in the main scanning direction and lies over a plurality of driving ICs 11. Moreover, the cover member 129 is formed so as to extend from the wiring substrate 6 to the head base body 3 so as to join the head base body 3 and the wiring substrate 6.

Figure 12A:
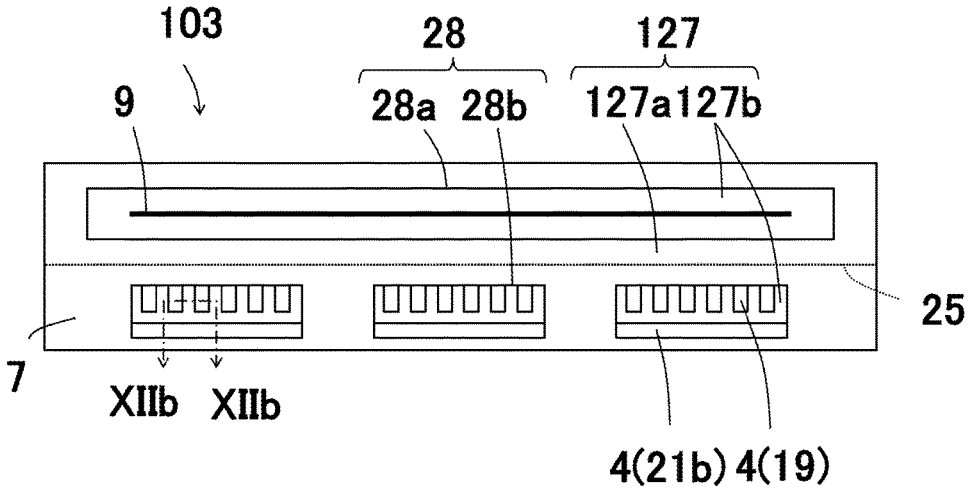
FIG. 12A is a plan view schematically showing a head base body constituting the thermal head according to the second embodiment.
Figure 12B:
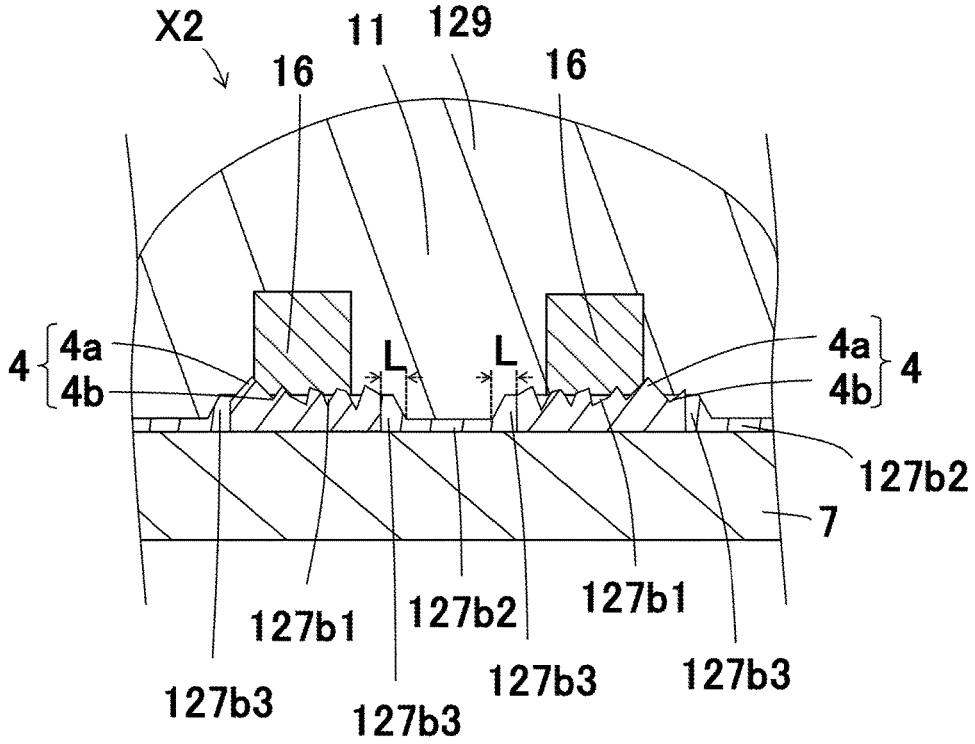
FIG. 12B is a sectional view taken along the line XIIb-XIIb shown in FIG. 12A.

As shown in FIGS. 12A and 12B, a cover layer 127 extends over substantially the entire area of the substrate 7, and has a first opening 28*a* and a second opening 28*b*. The first opening 28*a* and the second opening 28*b* are similar in configuration to the first opening 28*a* and the second opening 28*b*, respectively, of the thermal head X1, and detailed explanation thereof will thus be omitted.

The cover layer 127 comprises a first portion 127*a* and a second portion 127*b*. The second portion 127*b* is located inside the openings 28*a* and 28*b* to cover part of a pad 4. The second portion 127*b* has a near-side-surface portion 127*b*3. A second portion 127*b*1 is located on the pad 4 to protect the pad 4 against corrosion. A second portion 127*b*2 is located between the adjacent pads 4 so as to lie on the pad 4-free region of the substrate 7 to seal the opening 28*a*, 28*b*. The near-side-surface portion 127*b*3 is located on each of opposite side surfaces of the pad 4 in the main scanning direction to improve the capability of sealing the opposite side surfaces of the pad 4 in the main scanning direction.

The thermal head X2 is designed so that the second portion 127*b*2 is located between the adjacent pads 4 so as to lie on the pad 4-free region of the substrate 7. This makes it possible to seal a part of the substrate 7 which lies between the adjacent pads 4, and thereby improve the capability of sealing the opening 28*b*.

Moreover, it is preferable that the average thickness of the second portion 127*b*2 located between the adjacent pads 4 is greater than the average thickness of the second portion 127*b*1 located on the pad 4. This makes possible further improvement in the capability of sealing the opening 28*b*. Note that the average thickness of the second portion 127*b*2 may be obtained as, for example, an average value of the measured thicknesses of given three points of the second portion 127*b*2, and this holds true for the average thickness of the second portion 127*b*1.

Moreover, the near-side-surface portion 127*b*3 is located on each of the opposite side surfaces of the pad 4 in the main scanning direction, and is shaped so that its length (L) in the planar direction of the substrate 7 is larger gradually toward the substrate 7 as seen in a sectional view. In other words, the upper surface of the second portion 127*b*2, 127*b*3 located on the substrate 7 is concavely curved toward the substrate 7 as seen in a sectional view. In the second embodiment, the planar direction of the substrate 7 corresponds to a horizontal direction.

Thus, the near-side-surface portion 127*b*3 serves to compensate for a difference in level in the vicinity of the side surface of the pad 4. This makes it possible to dispose the cover member 129 so as to compensate for a difference in level, and thereby improve the anti-corrosion characteristics of the thermal head X2.

While one embodiment of the invention has been described heretofore, it should be understood that the application of the invention is not limited to the described embodiment, and that many modifications and variations of the invention are possible without departing from the scope of the invention. For example, while the thermal printer Z1 employing the thermal head X1 implemented as the first embodiment has been shown herein, the invention is not limited to this construction, and thus the thermal head X2 may be adopted for use in the thermal printer Z1.

For example, while a thin-film head having the thin heat generating section 9 obtained by designing the electrical resistance layer 15 in thin-film form has been exemplified, the invention is not limited to this construction. The invention may be embodied as a thick-film head having the thick heat generating section 9 obtained by designing the electrical resistance layer 15 in thick-film form.

Moreover, while a flat head in which the heat generating section 9 is formed on the substrate 7 has been exemplified, the invention may be embodied as an edge head in which the heat generating section 9 is disposed at the end face of the substrate 7.

Moreover, the heat storage layer 13 may be provided with an underlayer portion formed in other region than the protuberant portion 13*a*-bearing region. Furthermore, the heat generating section 9 may be constructed by forming the common electrode 17 and the discrete electrode 19 on the heat storage layer 13, and thereafter forming the electrical resistance layer 15 only in a region between the common electrode 17 and the discrete electrode 19.

The sealing member 12 and the cover member 29 for covering the driving IC 11 may be formed of the same material. In this case, in the process of printing the cover member 29, the cover member 29 and the sealing member 12 may be formed together at one time by performing printing also on a region where the sealing member 12 is to be formed.

REFERENCE SIGNS LIST

X1-X2: Thermal head
Z1: Thermal printer
1: Heat dissipating plate
2: Pad
2*a*: Convexity
2*b*: Concavity
3: Head base body
4: Pad
4*a*: Convexity
4*b*: Concavity
7: Substrate
9: Heat generating section
11: Driving IC
13: Heat storage layer
23: Joining member
25: Protective layer
27, 127: Cover layer
27*a*, 127*a*: First portion
27*b*, 127*b*: Second portion
127*b*3: Near-side-surface portion
28: Opening
28*a*: First opening
28*b*: Second opening
28*c*: Third opening
29: Cover member

The invention claimed is:

1. A thermal head, comprising:

a substrate;

a heat generating section disposed on the substrate;

an electrode electrically connected to the heat generating section;

a cover layer which covers part of the electrode;

a pad electrically connected to the electrode; and a joining member electrically connected to the pad, the cover layer comprising a first portion and a second portion which is smaller in thickness than the first portion, the second portion being placed on the pad, the pad including an exposed portion which exposes from the second portion, the joining member being connected to the exposed portion.

2. The thermal head according to claim 1, wherein the pad has an arithmetic surface roughness Sa of 0.1 μm to 1 μm, and the second portion has a thickness of 0.01 μm to 1 μm.

3. The thermal head according to claim 1, wherein the pad has a plurality of the exposed portions, and the exposed portions are apart from each other as seen in a plan view of the thermal head.

4. The thermal head according to claim 1, wherein a total area of the exposed portion constitutes 5 to 30% of an entire area of the pad inclusive of the exposed portion as seen in a plan view of the thermal head.

5. The thermal head according to claim 1, wherein the second portion is also disposed on the heat generating section.

6. The thermal head according to claim 1, wherein a concavity is formed in a surface of the pad, and the second portion is received in the concavity.

7. The thermal head according to claim 1, further comprising:

a driving IC electrically connected to the pad via the joining member, wherein the second portion is located between the driving IC and the pad.

8. The thermal head according to claim 1, wherein a plurality of the pads are disposed in a main scanning direction, and the second portion is located between adjacent pads.

9. The thermal head according to claim 8, wherein the second portion has a near-side-surface portion located on each of opposite side surfaces of the pad in the main scanning direction, and the near-side-surface portion is shaped so that its length in a planar direction of the substrate is larger gradually toward the substrate as seen in a sectional view of the thermal head.

10. A thermal printer, comprising:

the thermal head according to claim 1;

a conveyance mechanism which conveys a recording medium onto the heat generating section; and a platen roller which presses the recording medium against the heat generating section.

11. A method for manufacturing a thermal head, comprising:

a first step of preparing a substrate comprising a heat generating section, an electrode electrically connected to the heat generating section, and a pad electrically connected to the electrode;

a second step of forming a cover layer comprising a first portion which covers part of the electrode and a second portion which is disposed on the pad and is smaller in thickness than the first portion;

a third step of forming an exposed portion by exposing part of the pad to an outside of the second portion disposed on the pad; and a fourth step of forming a joining member on the pad, and electrically connecting the exposed portion of the pad and the joining member.

12. The method for manufacturing a thermal head according to claim 11, further comprising:

a step of forming the second portion on the heat generating section.

13. The thermal head according to claim 1, wherein the pad has a convexity, and a top of the convexity is exposed to the second portion.

14. The thermal head according to claim 8, wherein an average thickness of the second portion located between the adjacent pads is greater than an average thickness of the second portion located on the pad.

15. A thermal head, comprising:

a substrate;

a heat generating section disposed on the substrate;

an electrode electrically connected to the heat generating section;

a cover layer which covers part of the electrode;

a pad electrically connected to the electrode; and a joining member electrically connected to the pad, the cover layer comprising a first portion and a second portion which is smaller in thickness than the first portion, the second portion being placed on the pad, the pad including a concavity which is formed in a surface of the pad and an exposed portion which exposes from the second portion, the joining member being connected to the exposed portion the second portion is received in the concavity.

16. A thermal printer, comprising:

the thermal head according to claim 15;

a conveyance mechanism which conveys a recording medium onto the heat generating section; and a platen roller which presses the recording medium against the heat generating section.

* * * * *